US011858087B2

(12) United States Patent
Genozono

(10) Patent No.: US 11,858,087 B2
(45) Date of Patent: Jan. 2, 2024

(54) GRINDING APPARATUS

(71) Applicant: DISCO CORPORATION, Tokyo (JP)

(72) Inventor: Jiro Genozono, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 108 days.

(21) Appl. No.: 17/651,466

(22) Filed: Feb. 17, 2022

(65) Prior Publication Data

US 2022/0281063 A1 Sep. 8, 2022

(30) Foreign Application Priority Data

Mar. 5, 2021 (JP) ..... 2021-035240

(51) Int. Cl.
*B24B 37/10* (2012.01)
*B24B 49/12* (2006.01)
*B24B 7/04* (2006.01)

(52) U.S. Cl.
CPC ..... *B24B 37/10* (2013.01); *B24B 7/04* (2013.01); *B24B 49/12* (2013.01)

(58) Field of Classification Search
CPC ..... B24B 37/10; B24B 37/005; B24B 37/04; B24B 37/042; B24B 37/07; B24B 37/34; B24B 7/04; B24B 7/228; B24B 49/12; B24B 49/02; B24B 49/10; B24B 49/105; B24B 49/186; B24B 27/0046; B24B 27/02; B24B 41/06; B24B 41/002; B24B 41/047; B24B 41/053; B24B 47/20; B24B 63/017; B24B 63/02
USPC ..... 451/10
See application file for complete search history.

(56) References Cited

U.S. PATENT DOCUMENTS 6,572,444 B1 * 6/2003 Ball ..... B24B 7/228 451/6
2003/0077993 A1 * 4/2003 Shimobeppu ..... B24B 37/30 451/364

FOREIGN PATENT DOCUMENTS

JP 2012135853 A 7/2012
JP 2018058160 A * 4/2018 ..... B24B 47/20
JP 2020097089 A * 6/2020 ..... B24B 37/10
JP 2020124753 A * 8/2020 ..... B24B 37/005

* cited by examiner

*Primary Examiner* — Joel D Crandall
*Assistant Examiner* — Michael A Gump
(74) *Attorney, Agent, or Firm* — Greer Burns & Crain Ltd.

(57) ABSTRACT

There is provided a grinding apparatus including a chuck table configured to hold a workpiece, a grinding unit configured to grind the workpiece held by the chuck table by grinding stones fixed to a grinding wheel, a grinding feed mechanism configured to raise or lower the grinding unit, a reading unit configured to read a thickness of a base which thickness is recorded on a recording medium on which the thickness of the base of the grinding wheel is recorded, a base thickness storage section configured to store the thickness of the base which thickness is read by the reading unit, and a detecting unit configured to make the grinding unit perform processing by the grinding feed mechanism, and detect a fitting surface of a mount and the lower surface of a grinding stone of the grinding wheel fitted to the mount.

7 Claims, 5 Drawing Sheets

GRINDING APPARATUS

BACKGROUND OF THE INVENTION

Field of the Invention

The present invention relates to a grinding apparatus.

Description of the Related Art

Grinding processing of a workpiece by a grinding apparatus is performed by making grinding stones arranged annularly on a lower surface of a base of a grinding wheel included in a grinding unit abut against an upper surface of the workpiece held on a holding surface of a chuck table while rotating the grinding wheel. In the grinding processing, the grinding unit is first lowered at high speed toward the workpiece to a height position of the grinding unit immediately before a lower surfaces of the grinding stones and the upper surface of the workpiece abut against each other, a lowering speed of the grinding unit is next changed to a speed suitable for grinding the workpiece, and the workpiece is ground by lowering the grinding unit again. Shortening of a processing time is thereby achieved.

In order to perform the grinding processing of the workpiece, the grinding apparatus needs to recognize, in advance, the height position of the grinding unit when the lower surfaces of the grinding stones and the upper surface of the workpiece abut against each other. Therefore, as depicted in Japanese Patent Laid-Open No. 2012-135853, a setup work that makes the grinding apparatus store an original position as the height position of the grinding unit when the holding surface of the chuck table and the lower surfaces of the grinding stones abut against each other is performed before the grinding processing is performed. Then, the height position of the grinding unit raised by an amount of a thickness of the workpiece from the origin position stored in the grinding apparatus by the setup work is recognized as the height position of the grinding unit at which the lower surfaces of the grinding stones and the upper surface of the workpiece abut against each other.

The grinding wheel is replaced when the grinding stones are worn by a certain amount by the grinding processing. Conventionally, a present remaining amount of the grinding stones is calculated by subtracting a wear amount of the grinding stones worn by the grinding processing from a remaining amount of the grinding stones immediately after the replacement of the grinding wheel which remaining amount is measured by a vernier caliper or the like immediately after the replacement, and the grinding wheel is replaced when the calculated present remaining amount of the grinding stones falls below a predetermined value.

SUMMARY OF THE INVENTION

However, an error may occur between the remaining amount of the grinding stones which remaining amount is measured by an operator or the like by using the vernier caliper or the like immediately after the replacement of the grinding wheel and an actual remaining amount of the grinding stones. Hence, the workpiece may be damaged by continuing grinding even though the grinding stones do not remain, and grinding the workpiece by the base of the grinding wheel. Alternatively, even though the grinding stones actually remain, it is determined that the grinding stones have disappeared, and a worker is prompted to replace the grinding wheel, and replaces the grinding wheel.

That is, by reason of an error factor involved in the measurement of the remaining amount of the grinding stones, it is difficult to use the grinding stones to a limit where the grinding stones disappear.

It is accordingly an object of the present invention to provide a grinding apparatus that makes it possible to utilize grinding stones effectively by recognizing a remaining amount of the grinding stones.

In accordance with an aspect of the present invention, there is provided a grinding apparatus including a chuck table configured to hold a workpiece by a holding surface, a grinding unit in which a grinding wheel having grinding stones arranged annularly on a lower surface of a base is fitted to a mount coupled to a lower end of a spindle, the grinding unit being configured to grind the workpiece by the grinding stones, a grinding feed mechanism configured to raise or lower the grinding unit in a direction perpendicular to the holding surface, a control unit, a reading unit configured to read a thickness of the base, the thickness being recorded on a recording medium on which at least the thickness of the base of the grinding wheel is recorded, a base thickness storage section configured to store the thickness of the base, the thickness being read by the reading unit, and a detecting unit configured to lower the grinding unit by the grinding feed mechanism, and detect a fitting surface of the mount and a lower surface of the grinding stones of the grinding wheel fitted to the mount. The control unit includes a fitting surface height storage section configured to store a height of the grinding unit when the grinding unit is lowered by the grinding feed mechanism and the detecting unit detects the fitting surface of the mount, a grindstone lower surface height storage section configured to store a height of the grinding unit when the grinding unit is lowered by the grinding feed mechanism and the detecting unit detects the lower surface of the grinding stones after the grinding wheel is fitted to the mount, and a grindstone remaining amount calculating section configured to calculate a remaining amount of the grinding stones by subtracting the thickness of the base, the thickness being stored in the base thickness storage section, from a difference between the height stored in the fitting surface height storage section and the height stored in the grindstone lower surface height storage section.

The grinding apparatus according to the present invention stores the thickness of the base in the base thickness storage section and calculates the remaining amount of the grinding stone by subtracting the stored thickness of the base from a distance from the lower surface of the grinding stone to the fitting surface of the mount. Hence, a measurement using a vernier caliper or the like as in the past becomes unnecessary, and the remaining amount of the grinding stone can be recognized and managed properly. In addition, even when the thickness of the base varies, the remaining amount of the grinding stone can be calculated excellently. Further, in the grinding apparatus, it is possible to check whether there is a difference between an actual remaining amount of the grinding stone used to a certain extent and the remaining amount of the grinding stone which remaining amount is calculated and recognized by the grindstone remaining amount calculating section.

The above and other objects, features and advantages of the present invention and the manner of realizing them will become more apparent, and the invention itself will best be understood from a study of the following description and appended claims with reference to the attached drawings showing some preferred embodiment of the invention.

DETAILED DESCRIPTION OF THE PREFERRED EMBODIMENT

1 Configuration of Grinding Apparatus

Figure 1:
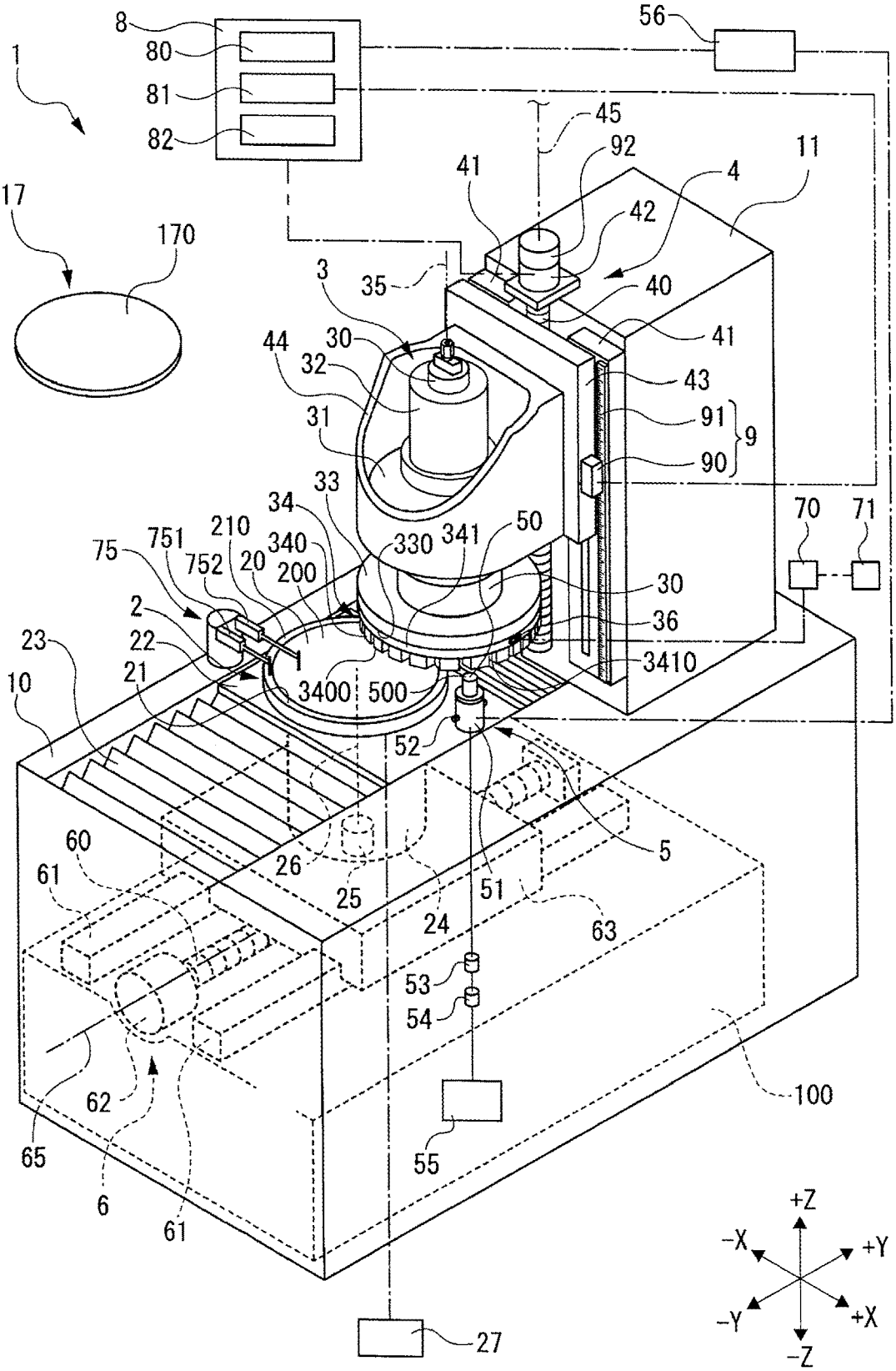
FIG. 1 is a perspective view depicting the whole of a grinding apparatus.

A grinding apparatus 1 depicted in FIG. 1 is a grinding apparatus that grinds a workpiece 17 by using a grinding unit 3. A configuration of the grinding apparatus 1 will be described in the following.

As depicted in FIG. 1, the grinding apparatus 1 includes a base 10 extended in a Y-axis direction.

A chuck table 2 is disposed on the base 10. The chuck table 2 includes a sucking portion 20 and a frame body 21 that supports the sucking portion 20. An upper surface of the sucking portion 20 is a holding surface 200 on which the workpiece 17 is held. An upper surface 210 of the frame body 21 is formed so as to be flush with the holding surface 200.

The chuck table 2 is supported by a bottomed tubular casing 24. A rotating mechanism 25 connected to the chuck table 2 is disposed inside the casing 24. The rotating mechanism 25 can rotate the chuck table 2 about a rotational axis 26 in a Z-axis direction.

A suction source 27 is connected to the sucking portion 20. A suction force is transmitted to the holding surface 200, which is the upper surface of the sucking portion 20, by actuating the suction source 27. For example, when the suction source 27 is actuated in a state in which the workpiece 17 is mounted on the holding surface 200, the workpiece 17 can be sucked and held by the holding surface 200.

An internal base 100 is disposed inside the base 10. A horizontal moving mechanism 6 is disposed on the internal base 100. The horizontal moving mechanism 6 includes a ball screw 60 having a rotational axis 65 in the Y-axis direction, a pair of guide rails 61 arranged in parallel with the ball screw 60, a motor 62 that is coupled to the ball screw 60 and rotates the ball screw 60 about the rotational axis 65; and a movable plate 63 that has an internal nut screwed onto the ball screw 60, and has a bottom portion in sliding contact with the guide rails 61. The casing 24 is supported on the movable plate 63.

In the horizontal moving mechanism 6, when the motor 62 rotates the ball screw 60 about the rotational axis 65, the movable plate 63 moves in the Y-axis direction while being guided by the guide rails 61. As the movable plate 63 moves in the Y-axis direction, the casing 24 supported by the movable plate 63 and the chuck table 2 supported by the casing 24 integrally move in the Y-axis direction.

A cover 22 and bellows 23 coupled to the cover 22 so as to be capable of expansion and contraction are arranged on the periphery of the chuck table 2. When the chuck table 2 moves in the Y-axis direction, the cover 22 moves in the Y-axis direction together with the chuck table 2, and the bellows 23 expand or contract.

A column 11 is erected on a +Y direction side of the base 10. A grinding feed mechanism 4 that vertically moves the grinding unit 3 in the Z-axis direction as a direction perpendicular to the holding surface 200 is disposed on a side surface on a −Y direction side of the column 11.

The grinding unit 3 includes a spindle 30 having a rotational axis 35 in the Z-axis direction, a housing 31 that rotatably supports the spindle 30, a spindle motor 32 that rotationally drives the spindle 30 about the rotational axis 35, a mount 33 coupled to a lower end of the spindle 30, and a grinding wheel 34 detachably fitted to a lower surface of the mount 33.

The grinding wheel 34 includes a base 341 and a plurality of grinding stones 340 in a substantially rectangular parallelepipedic shape which grinding stones are arranged annularly on a lower surface of the base 341. Lower surfaces 3400 of the grinding stones 340 are a grinding surface that comes into contact with the workpiece 17.

When the spindle 30 is rotated by using the spindle motor 32, the mount 33 connected to the spindle 30 and the grinding wheel 34 fitted to the lower surface of the mount 33 rotate integrally.

The grinding feed mechanism 4 includes a ball screw 40 having a rotational axis 45 in the Z-axis direction, a pair of guide rails 41 arranged in parallel with the ball screw 40, a Z-axis motor 42 that rotates the ball screw 40 about the rotational axis 45 in the Z-axis direction, an encoder 92 for detecting the rotational angle of the Z-axis motor 42, a raising and lowering plate 43 that has an internal nut screwed onto the ball screw 40 and that has a side portion in sliding contact with the guide rails 41, and a holder 44 that is coupled to the raising and lowering plate 43 and that supports the grinding unit 3.

When the ball screw 40 is driven by the Z-axis motor 42 and thereby the ball screw 40 rotates about the rotational axis 45, the raising and lowering plate 43 correspondingly moves vertically in the Z-axis direction while guided by the guide rails 41, and the grinding unit 3 held by the holder 44 correspondingly moves in the Z-axis direction as a direction perpendicular to the holding surface 200.

A recording medium 36 is provided to the side surface of the base 341 of the grinding wheel 34. The recording medium 36 is, for example, a sticker on which a bar code such as one-dimensional code or the like is printed. The recording medium 36 is affixed to the side surface of the base 341. A thickness of the base 341 is recorded on the recording medium 36. That is, information including information regarding the thickness of the base 341 is recorded on the recording medium 36.

The grinding apparatus 1 includes a reading unit 70 that reads the thickness of the base 341 which thickness is recorded on the recording medium 36. The reading unit 70 is, for example, a bar code reader that reads the above-described one-dimensional code or the like.

The grinding apparatus 1 includes a base thickness storage unit 71 that stores the thickness of the base 341 which thickness is read by the reading unit 70. The base thickness storage unit 71 is connected to the reading unit 70. The information regarding the thickness of the base 341 which is read by the reading unit 70 is transmitted to the base thickness storage unit 71 and is stored in the base thickness storage unit 71.

The grinding apparatus 1 includes a control unit 8 that controls various operations of the grinding apparatus 1.

A detecting unit 5 that comes into contact with each of the lower surface 3400 of a grinding stone 340 and a fitting surface 330 of the mount 33, and detects the lower surface 3400 of the grinding stone 340 and the fitting surface 330 of the mount 33 is disposed on the cover 22 and on a side of the chuck table 2.

The detecting unit 5 includes a cylinder 51, a table 50 provided such that a lower portion thereof is housed in the cylinder 51 and an upper portion thereof projects upward from the cylinder 51, and a sensor 52 disposed inside the cylinder 51.

The table 50 is provided onto the cylinder 51 disposed on the cover 22 so as to be able to come into contact with the grinding stone 340 or the base 341 when the grinding unit 3 is lowered in a −Z direction.

Figure 2:
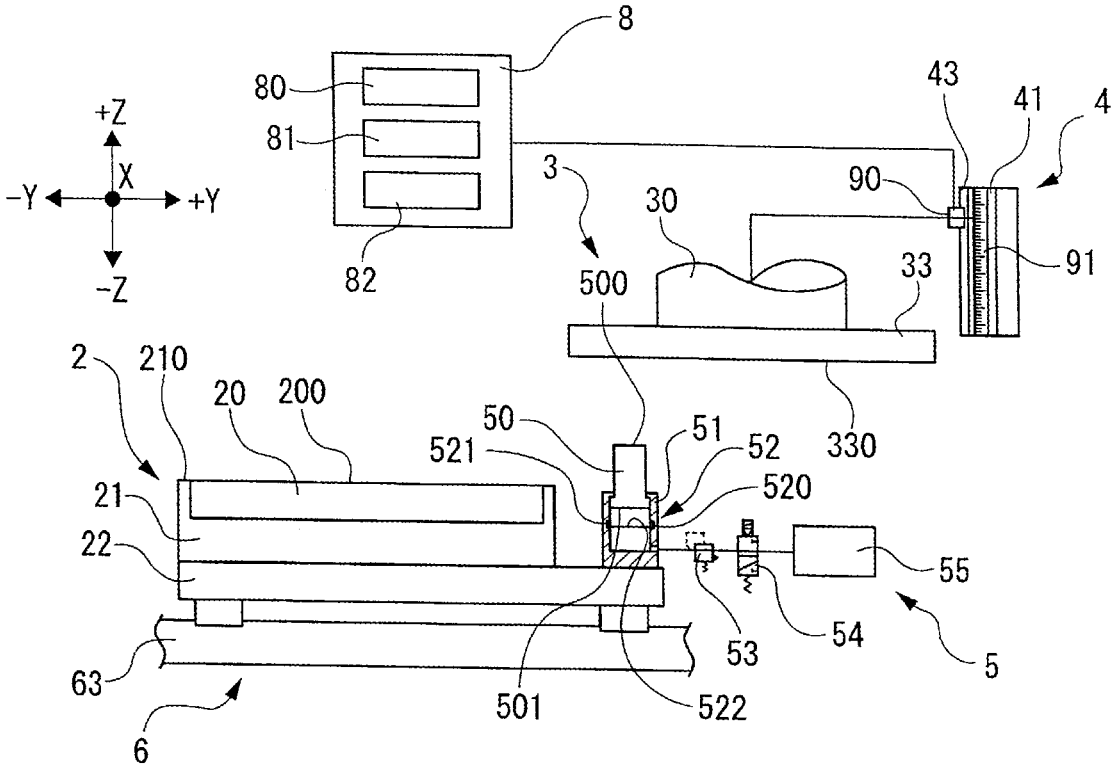
FIG. 2 is a sectional view depicting the grinding apparatus when a detector is positioned below a mount.

The sensor 52 in the present embodiment is a transmissive type photoelectric sensor. As depicted in FIG. 2, the sensor 52 includes a light emitting portion 520 and a light receiving portion 521. During operation of the grinding apparatus 1, light continuing to be emitted from the light emitting portion 520 travels in a straight line along a detection line 522. and is received by the light receiving portion 521.

As depicted in FIG. 1, a signal transmitting unit 56 is connected to the sensor 52. When the light emitted from the light emitting portion 520 ceases to be received by the light receiving portion 521, a detection signal is transmitted from the signal transmitting unit 56 to the control unit 8.

As depicted in FIG. 1 and FIG. 2, the cylinder 51 of the detecting unit 5 is connected to an air source 55 via a relief valve 53 and a valve 54. The table 50 is biased in a +Z direction by the cylinder 51 pressurized by feeding the cylinder 51 with an air produced by the air source 55. The table 50 is positioned at an upper limit position in a state in which no pressing force is applied to the table 50 from above. When the air inside the cylinder 51 is pressurized by pushing the table 50 from above, and thereby the pressure of the air inside the cylinder 51 becomes a pressure equal to or higher than a predetermined pressure, the relief valve 53 is opened as appropriate, and the air supplied from the air source 55 into the cylinder 51 is exhausted to a space outside the cylinder 51, so that the pressure applied to the inside of the cylinder 51 is held constant.

As depicted in FIG. 1, the raising and lowering plate 43 is provided with a height measuring unit 90 that moves together with the raising and lowering plate 43 and measures the height position in the Z-axis direction of the grinding unit 3. In addition, the guide rails 41 are provided with a scale 91 having graduations. The height measuring unit 90 reads a value (graduation) on the scale 91. The height position of the grinding unit 3 moved in the Z-axis direction by the grinding feed mechanism 4 is thereby measured.

Incidentally, the height position of the grinding unit 3 may be measured on the basis of a height signal (signal indicating the height position of the grinding unit 3) output from the encoder 92 detecting the rotational angle of the Z-axis motor 42.

The control unit 8 includes a fitting surface height storage section 80. The fitting surface height storage section 80 has a function of storing the height of the grinding unit 3 when the grinding unit 3 is lowered by the grinding feed mechanism 4 and the detecting unit 5 detects the fitting surface 330 of the mount 33.

The control unit 8 includes a grindstone lower surface height storage section 81. The grindstone lower surface height storage section 81 has a function of storing the height of the grinding unit 3 when the grinding unit 3 is lowered by the grinding feed mechanism 4 and the detecting unit 5 detects the lower surface 3400 of the grinding stone 340 after the grinding wheel 34 is fitted to the mount 33.

The control unit 8 includes a grindstone remaining amount calculating section 82. The grindstone remaining amount calculating section 82 has a function of calculating a remaining amount of the grinding stone 340 by subtracting the thickness of the base 341 which thickness is stored in the base thickness storage unit 71 from a difference between the height stored in the fitting surface height storage section 80 and the height stored in the grindstone lower surface height storage section 81.

2 Operation of Grinding Apparatus

Description will be made of operation when the grinding apparatus 1 grinds the workpiece 17. In this case, first, an operator or the control unit 8 makes the workpiece 17 sucked and held on the holding surface 200 of the chuck table 2 depicted in FIG. 1.

Thereafter, the control unit 8 positions the chuck table 2 below the grinding unit 3 by the horizontal moving mechanism 6.

Next, the control unit 8 rotates the workpiece 17 held on the holding surface 200 by rotating the chuck table 2 about the rotational axis 26 by the rotating mechanism 25, and rotates the grinding stones 340 about the rotational axis 35 by using the spindle motor 32.

In this state, the control unit 8 lowers the grinding unit 3 in the −Z direction by using the grinding feed mechanism 4. The lower surfaces 3400 of the grinding stones 340 thereby come into contact with an upper surface 170 of the workpiece 17. From this state, the control unit 8 further lowers the grinding stones 340 in the −Z direction. The workpiece 17 is thereby ground by the grinding stones 340. When the workpiece 17 is ground to a predetermined thickness, the control unit 8 ends the grinding processing on the workpiece 17.

Such grinding wears the lower surfaces 3400 of the grinding stones 340, and reduces an amount of projection (remaining amount) of the grinding stones 340 from a lower surface 3410 of the base 341. The grinding wheel 34 is therefore replaced with a new one immediately before the remaining amount of the grinding stones 340 disappears.

Accordingly, in the grinding apparatus 1, the control unit 8 performs processing of recognizing the remaining amount of the grinding stones 340 by using the detecting unit 5 in appropriate timing. Incidentally, such processing is performed also when the grinding wheel 34 is replaced with a new one. In the following, description will be made of operation when the grinding apparatus 1 recognizes the remaining amount of the grinding stones 340.

In order to recognize the remaining amount of the grinding stones 340, the control unit 8 reads the thickness of the base 341 which is recorded on the recording medium 36 by using the reading unit 70 when the grinding wheel 34 is fitted to the mount 33. The read thickness of the base 341 is stored in the base thickness storage unit 71.

In addition, in a state in which the grinding wheel 34 is not fitted to the mount 33, the control unit 8 lowers the grinding unit 3 in the −Z direction by the grinding feed mechanism 4, and detects the fitting surface 330 of the mount 33 of the grinding unit 3 by using the detecting unit 5. Then, the control unit 8 stores, in the fitting surface height storage section 80, the height of the grinding unit 3 when the fitting surface 330 of the mount 33 is detected.

Specifically, as depicted in FIG. 2, the control unit 8 first positions a contact surface 500 of the table 50 of the detecting unit 5 below the mount 33 by moving the movable plate 63 in the Y-axis direction by the horizontal moving mechanism 6.

Figure 3:
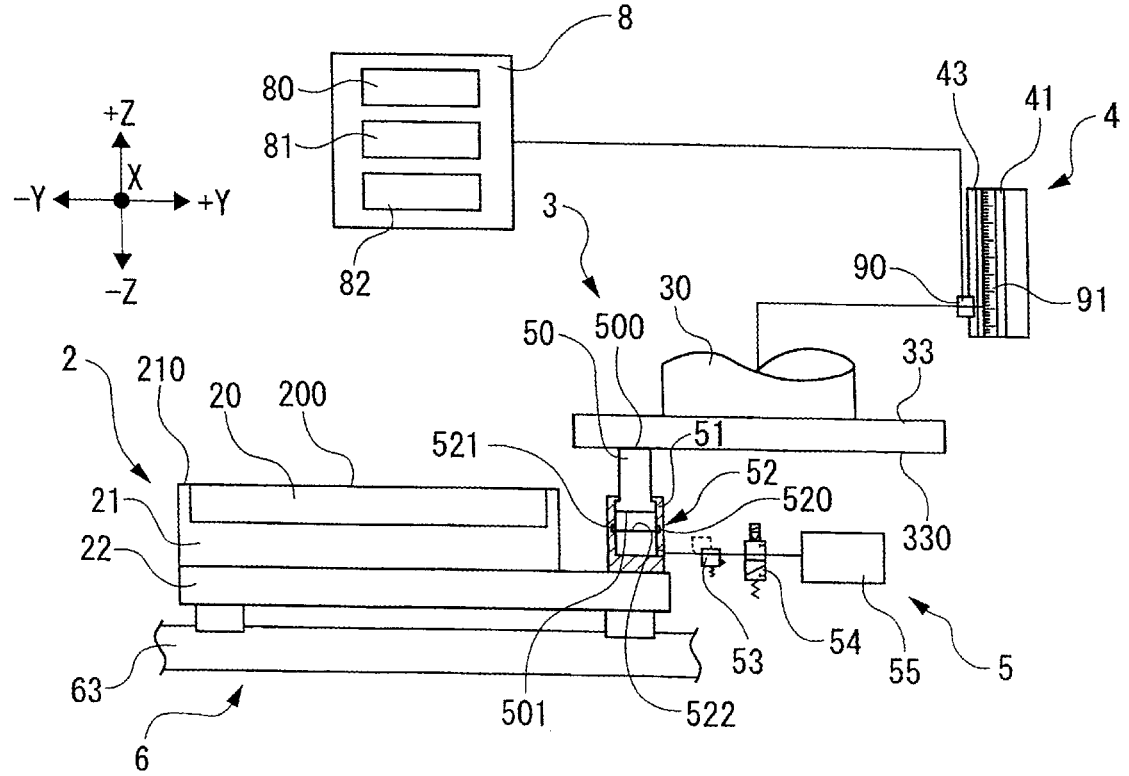
FIG. 3 is a sectional view depicting the grinding apparatus when the detector is in contact with a lower surface of the mount.

Next, as depicted in FIG. 3, the control unit 8 lowers the grinding unit 3 in the −Z direction by the grinding feed mechanism 4, and thereby makes the fitting surface 330 of the mount 33 and the contact surface 500 of the table 50 come into contact with each other. In this state, the control unit 8 further lowers the mount 33 in the −Z direction by the grinding feed mechanism 4, and depresses the table 50 downward by the fitting surface 330 of the mount 33.

Figure 4:
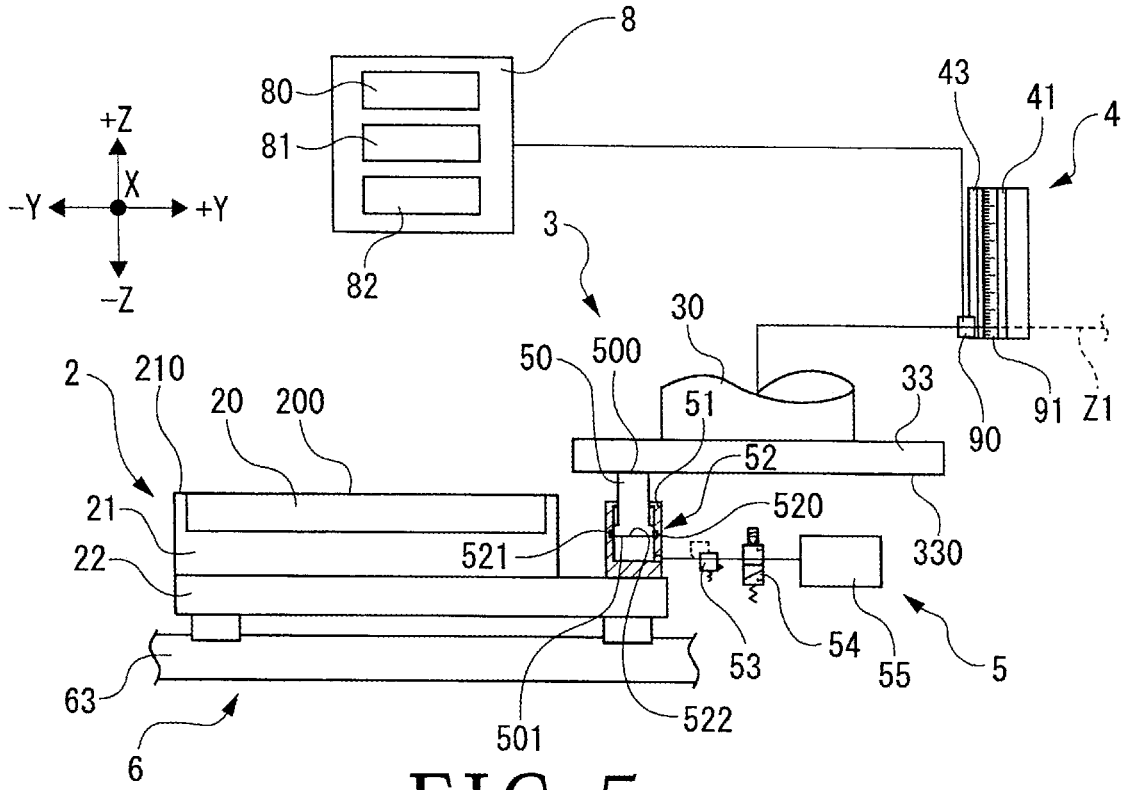
FIG. 4 is a sectional view depicting the grinding apparatus when the detector is depressed by the lower surface of the mount.

Then, as depicted in FIG. 4, when the lower surface 501 of the table 50 is depressed to the position of the detection line 522 of the sensor 52, the light emitted from the light emitting portion 520 of the sensor 52 is interrupted by the table 50, and ceases to be received by the light receiving portion 521. At a moment at which the light ceases to be received by the light receiving portion 521, a detection signal to the effect that the fitting surface 330 of the mount 33 is detected is transmitted from the signal transmitting unit 56 of the detecting unit 5 to the control unit 8.

At this time, air is exhausted via the relief valve 53 connected to the inside of the cylinder 51 so that the depression of the table 50 does not raise the pressure applied to the inside of the cylinder 51. The inside of the cylinder 51 is thereby maintained at a substantially constant pressure. Consequently, a force in the +Z direction which force is applied from the contact surface 500 of the table 50 to the fitting surface 330 of the mount 33 is held substantially constant. An excellent measurement can therefore be performed. Incidentally, when the recognition of the remaining amount of the grinding stones 340 is not performed, the air inside the cylinder 51 is exhausted, so that the table 50 is lowered to a lowest position, and the contact surface 500 of the table 50 is positioned below the holding surface 200.

Then, when the control unit 8 receives the detection signal to the effect that the fitting surface 330 of the mount 33 is detected, the control unit 8 stops the lowering of the grinding unit 3 by controlling the grinding feed mechanism 4. In addition, the control unit 8 recognizes, as a first height Z1 of the grinding unit 3, the value of the scale 91 read by the height measuring unit 90 when the detection signal is received, and stores the first height Z1 in the fitting surface height storage section 80.

Incidentally, the measurement of the height position of the grinding unit 3 when the fitting surface 330 of the mount 33 is detected is performed at a time of replacement of a spindle unit or the like. That is, the measurement does not always need to be performed when the grinding wheel 34 is replaced. Incidentally, the grinding apparatus 1 recognizes, in advance, a difference between the height of the contact surface 500 of the table 50 and the height of the holding surface 200 when the lower surface 501 of the table 50 of the detecting unit 5 is depressed to the position of the detection line 522 of the sensor 52.

Thereafter, the control unit 8 raises the grinding unit 3 by the grinding feed mechanism 4, and thereby separates the grinding wheel 34 from the table 50.

Thereafter, the operator fits the grinding wheel 34 to the mount 33. Next, the control unit 8 lowers the grinding unit 3 in the −Z direction by the grinding feed mechanism 4, and detects the lower surface 3400 of a grinding stone 340 by using the detecting unit 5. Then, the control unit 8 stores, in the grindstone lower surface height storage section 81, the height of the grinding unit 3 when the lower surface 3400 of the grinding stone 340 is detected.

Figure 5:
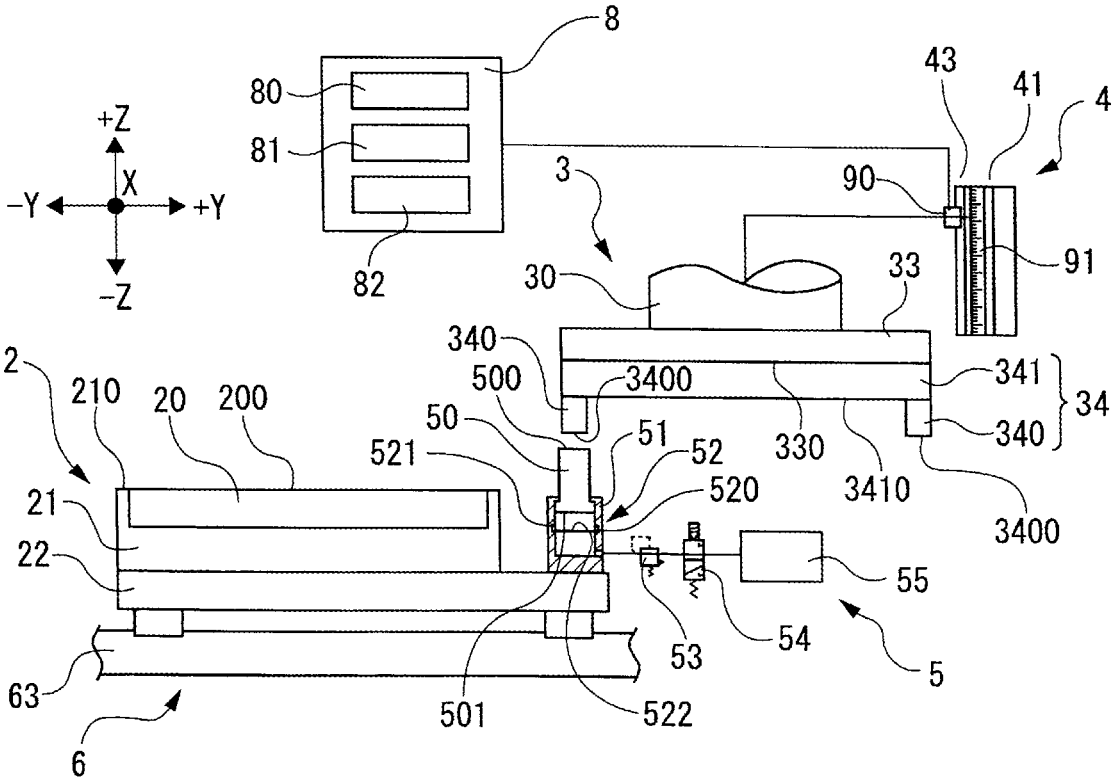
FIG. 5 is a sectional view depicting the grinding apparatus when the detector is positioned below a grinding stone.

Specifically, as depicted in FIG. 5, the control unit 8 first positions the contact surface 500 of the table 50 of the detecting unit 5 below the grinding stone 340 by moving the movable plate 63 in the Y-axis direction by the horizontal moving mechanism 6.

Figure 6:
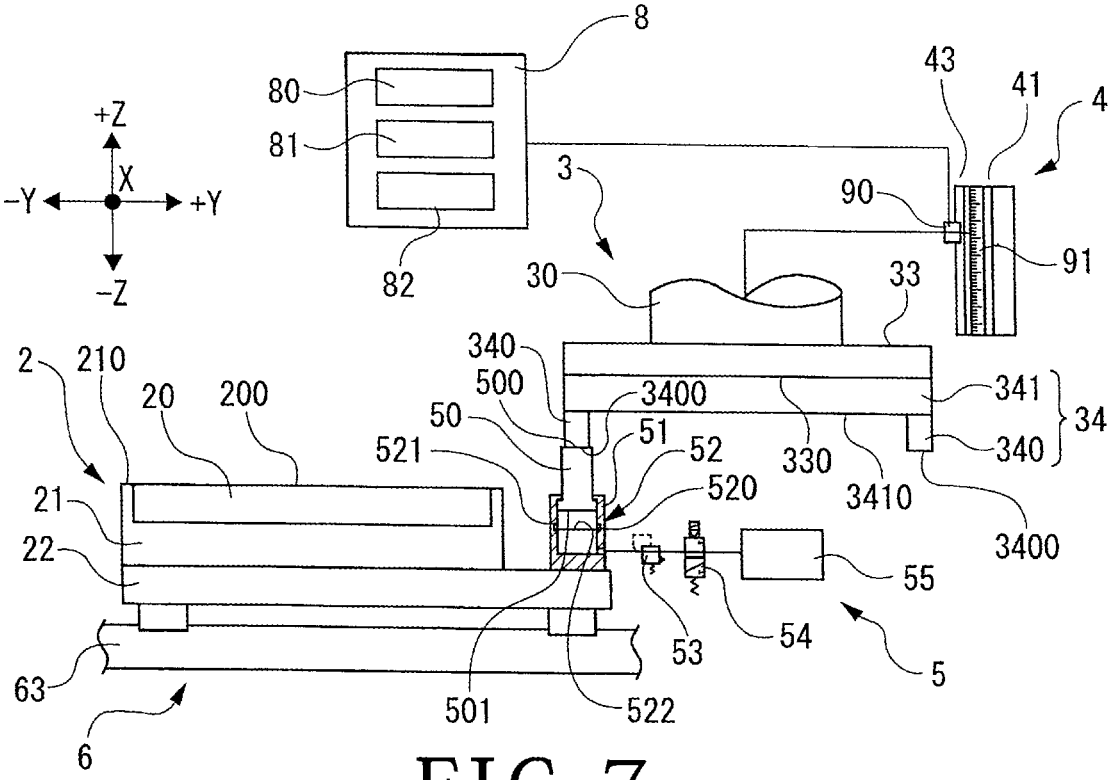
FIG. 6 is a sectional view depicting the grinding apparatus when the detector is in contact with a lower surface of the grinding stone.

Next, as depicted in FIG. 6, the control unit 8 lowers the grinding unit 3 in the −Z direction by the grinding feed mechanism 4, and thereby makes the lower surface 3400 of the grinding stone 340 and the contact surface 500 of the table 50 come into contact with each other.

In this state, the control unit 8 further lowers the grinding stone 340 in the −Z direction by the grinding feed mechanism 4, and depresses the table 50 downward by the lower surface 3400 of the grinding stone 340.

Figure 7:
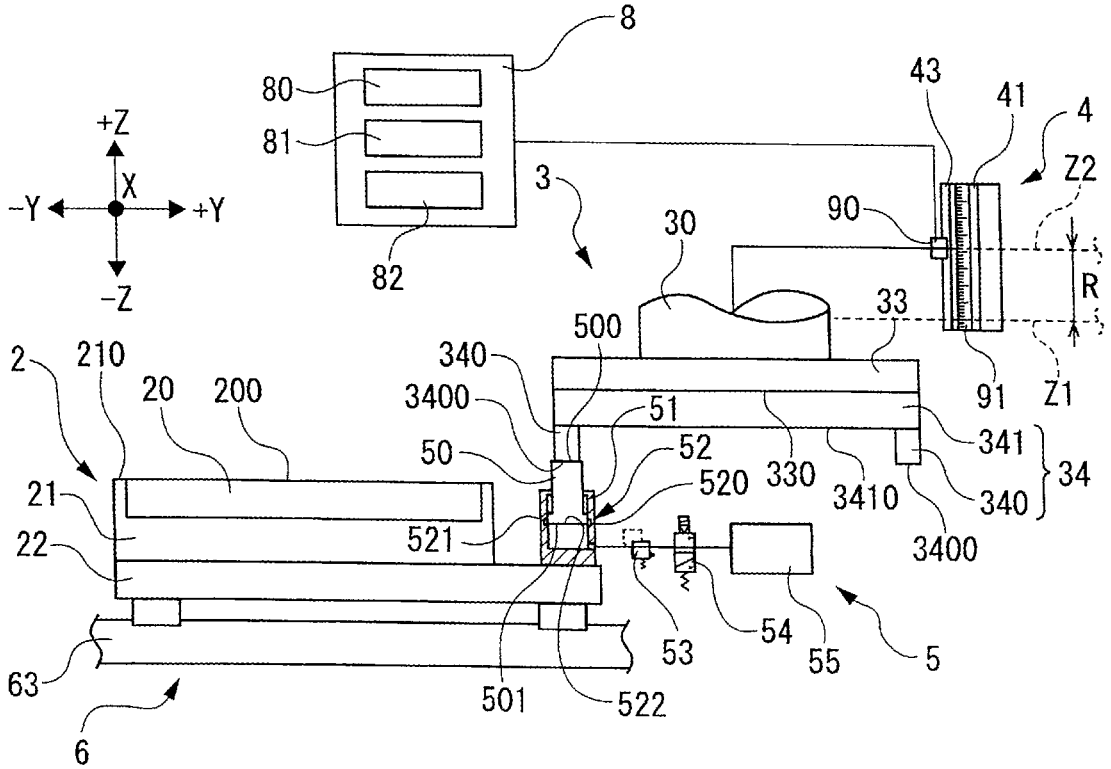
FIG. 7 is a sectional view depicting the grinding apparatus when the detector is depressed by the lower surface of the grinding stone.

Then, as depicted in FIG. 7, when the lower surface 501 of the table 50 is depressed to the position of the detection line 522 of the sensor 52, the light emitted from the light emitting portion 520 of the sensor 52 is interrupted by the table 50, and ceases to be received by the light receiving portion 521. At a moment at which the light ceases to be received by the light receiving portion 521, a detection signal to the effect that the lower surface 3400 of the grinding stone 340 is detected is transmitted from the signal transmitting unit 56 of the detecting unit 5 to the control unit 8.

Then, when the control unit 8 receives the detection signal to the effect that the lower surface 3400 of the grinding stone 340 is detected, the control unit 8 stops the lowering of the grinding unit 3 by controlling the grinding feed mechanism 4. In addition, the control unit 8 recognizes, as a second height Z2 of the grinding unit 3, the value of the scale 91 read by the height measuring unit 90 when the detection signal is received, and stores the second height Z2 in the grindstone lower surface height storage section 81.

Next, the grindstone remaining amount calculating section 82 calculates a difference between the first height Z1 stored in the fitting surface height storage section 80 and the second height Z2 stored in the grindstone lower surface height storage section 81 as a distance R from the lower surface 3400 of the grinding stone 340 to the fitting surface 330 of the mount 33.

Thereafter, the grindstone remaining amount calculating section 82 obtains the remaining amount of the grinding stone 340 by subtracting the thickness of the base 341 which thickness is stored in the base thickness storage unit 71 from the difference between the first height Z1 and the second height Z2, that is, the distance R from the lower surface 3400 of the grinding stone 340 to the fitting surface 330 of the mount 33.

As described above, the grinding apparatus 1 stores the thickness of the base 341 in the base thickness storage unit 71, and calculates the remaining amount of the grinding stone 340 by subtracting the stored thickness of the base 341 from the distance R from the lower surface 3400 of the grinding stone 340 to the fitting surface 330 of the mount 33. Hence, a measurement using a vernier caliper as in the past or the like becomes unnecessary, and the remaining amount of the grinding stone can be recognized properly. In addition, even when the thickness of the base 341 varies, the remaining amount of the grinding stone 340 can be calculated excellently. It is further possible to check whether there is a difference between an actual remaining amount of the grinding stone 340 used to a certain extent and the calculated and recognized remaining amount of the grinding stone 340.

Incidentally, the control unit 8 may display the value of the calculated remaining amount of the grinding stone 340 on a display not depicted, which display is provided to the grinding apparatus 1. In this case, the operator can easily grasp the remaining amount of the grinding stone 340, and therefore appropriately determine whether or not to replace the grinding wheel 34.

In addition, the control unit 8 may be configured to notify the operator that the grinding wheel 34 is to be replaced by, for example, sounding an alarm sound when the calculated remaining amount of the grinding stone 340 is smaller than a predetermined value.

Figure 8:
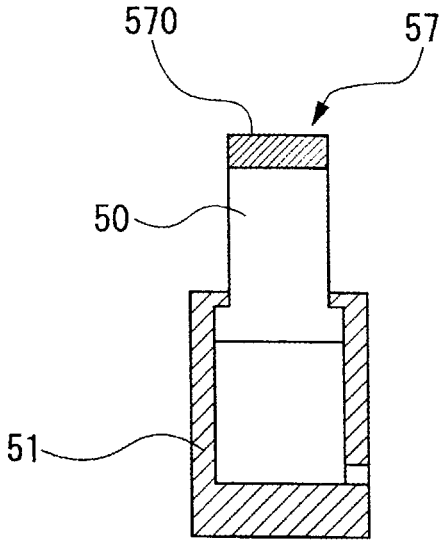
FIG. 8 is a sectional view depicting a detector including an AE sensor.

Incidentally, the detecting unit 5 may include an acoustic emission (AE) sensor having a contact 57 at an upper end of the table 50 as depicted in FIG. 8, in place of the sensor 52 as a transmissive photoelectric sensor depicted in FIG. 2, for example. In a case where the AE sensor is used, in detecting the lower surface 3400 of the grinding stone 340, for example, at a moment at which the lower surface 3400 of the grinding stone 340 and an upper surface 570 of the contact 57 of the AE sensor come into contact with each other, the lower surface 3400 of the grinding stone 340 is detected, and a detection signal to the effect that the lower surface 3400 of the grinding stone 340 is detected is transmitted from the signal transmitting unit 56 of the detecting unit 5 to the control unit 8. When the AE sensor is used, the grinding stone 340 does not need to be lowered by the grinding feed mechanism 4 after the upper surface 570 of the contact 57 of the AE sensor and the lower surface 3400 of the grinding stone 340 come into contact with each other. Hence, a time taken to calculate the remaining amount of the grinding stone 340 can be shortened.

Figure 9:
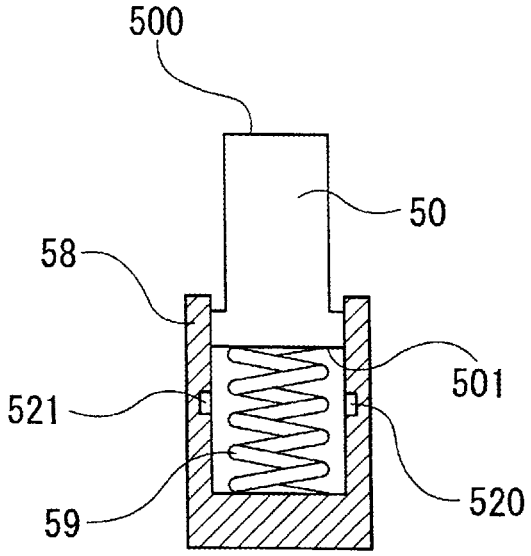
FIG. 9 is a sectional view depicting a detector including a spring.

In addition, as depicted in FIG. 9, the detecting unit 5 may include a bottomed cylinder 58 that houses the table 50 and that has an upper portion opened, and a spring 59 surrounded by the bottomed cylinder 58. The spring 59 has one end connected to the lower surface 501 of the table 50 and has another end fixed to an internal bottom portion of the bottomed cylinder 58. The table 50 can be biased upward by using the spring 59 without a pressure generating mechanism such as the air source 55 or the like being provided to the grinding apparatus 1. It is therefore possible to reduce the size of the grinding apparatus 1 as a whole, and reduce cost for generating the pressure.

In addition, the configuration depicted in FIG. 9 may be provided with a proximity sensor that detects the lower surface 501 of the lowered table 50. In addition, with the configuration depicted in FIG. 9, the cylinder 51 of the detecting unit 5 is disposed at a position such that the grinding stones 340 can avoid coming into contact with the table 50 when the grinding processing is performed. The cylinder 51 is, for example, disposed at a position shifted in a −Y direction from the position depicted in FIG. 1.

In addition, in the present embodiment, the cylinder 51 of the detecting unit 5 is disposed on the cover 22. In regard to this, the cylinder 51 of the detecting unit 5 may be disposed on the movable plate 63, and the cylinder 51 and the table 50 may project from the cover 22.

It is to be noted that the recording medium 36 is not limited to the above-described one-dimensional code and may, for example, be a two-dimensional code or an RFID. In addition, the recording medium 36 is not limited to being affixed to the side surface of the base 341 as a sticker and may be directly included in the side surface of the base 341 by laser marking or the like. The recording medium 36 may be, for example, printed on an inspection table for the grinding wheel 34.

In addition, in a case where the measurement of the height of the grinding unit 3 is performed on the basis of a height signal output from the encoder 92, the fitting surface height storage section 80 and the grindstone lower surface height storage section 81, for example, receive height signals from the encoder 92, and the height difference is calculated on the basis of the height signals.

Incidentally, as depicted in FIG. 1, the grinding apparatus 1 may include a thickness measuring unit 75 that measures a thickness of the workpiece 17. The thickness measuring unit 75 includes a holding surface height measuring instrument 751 that measures the height of the holding surface 200 and an upper surface height measuring instrument 752 that measures the height of the upper surface 170 of the workpiece 17. A difference between the value of the holding surface height measuring instrument 751 and the value of the upper surface height measuring instrument 752 is calculated as the thickness of the workpiece 17.

The control unit 8 stores the height position of the grinding unit 3 when the grinding of the workpiece 17 is completed, and recognizes the height position of the grinding unit 3 at which height position the lower surfaces 3400 of the grinding stones 340 are in contact with the holding surface 200 by subtracting the thickness of the workpiece 17 after the grinding from the height position of the grinding unit 3 when the grinding of the workpiece 17 is completed. The control unit 8 can, for example, obtain the remaining amount of the grinding stone 340 by subtracting, from this height position, the height position of the grinding unit 3 when the fitting surface 330 of the mount 33 is in contact with the holding surface 200, which height position is recognized in advance, and the thickness of the base 341 of the grinding wheel 34 which thickness is stored in the base thickness storage unit 71. That is, the control unit 8 can recognize the remaining amount of the grinding stone 340 by measuring the thickness of the workpiece 17 at a time of the completion of the grinding.

A generally called setup that sets the origin of the grinding stone 340 at a time of grinding the workpiece 17 by the grinding apparatus 1 recognizes the height position of the grinding unit 3 when the grinding stones 340 are brought into contact with the holding surface 200 of the chuck table 2 by lowering the grinding unit 3 by the grinding feed mechanism 4. In the present embodiment, the setup that recognizes the height position of the grinding unit 3 at which height position the lower surfaces 3400 of the grinding stones 340 are in contact with the holding surface 200 is completed by calculating the remaining amount of the grinding stones 340.

Further, also in a case of dressing the grinding stones 340, the lower surfaces 3400 of the grinding stones 340 are brought into contact with a dressing board held on the chuck table 2 or a sub-table not depicted by lowering the grinding unit 3 by the grinding feed mechanism 4. It is therefore possible to perform, as a series of operations, the dressing of the lower surfaces 3400 of the grinding stones 340, measurement of a thickness of the dressing board by the thickness measuring unit 75, and the recognition of the remaining amount of the grinding stone 340 by using the height position of the grinding unit 3 which height position is recognized by the recognition of the height position of the grinding unit 3 by the scale 91.

The present invention is not limited to the details of the above described preferred embodiment. The scope of the invention is defined by the appended claim and all changes and modifications as fall inside the equivalence of the scope of the claim are therefore to be embraced by the invention.

What is claimed is:

1. A grinding apparatus comprising:

a chuck table configured to hold a workpiece by a holding surface;

a grinding unit in which a grinding wheel having grinding stones arranged annularly on a lower surface of a base is fitted to a mount coupled to a lower end of a spindle, the grinding unit being configured to grind the workpiece by the grinding stones;

a grinding feed mechanism configured to raise or lower the grinding unit in a direction perpendicular to the holding surface;

a control unit;

a reading unit configured to read a thickness of the base, the thickness being recorded on a recording medium on which at least the thickness of the base of the grinding wheel is recorded;

a base thickness storage unit configured to store the thickness of the base, the thickness being read by the reading unit; and a detecting unit configured to lower the grinding unit by the grinding feed mechanism, and detect a fitting surface of the mount and a lower surface of the grinding stones of the grinding wheel fitted to the mount;

wherein the control unit is configured to:

store a height of the grinding unit when the grinding unit is lowered by the grinding feed mechanism and the detecting unit detects the fitting surface of the mount, store a height of the grinding unit when the grinding unit is lowered by the grinding feed mechanism and the detecting unit detects the lower surface of the grinding stones after the grinding wheel is fitted to the mount, and calculate a remaining amount of the grinding stones by subtracting the thickness of the base, the thickness being stored in the base thickness storage unit, from a difference between the height of the grinding unit when the grinding unit is lowered by the grinding feed mechanism and the detecting unit detects the fitting surface of the mount and the height of the grinding unit when the grinding unit is lowered by the grinding feed mechanism and the detecting unit detects the lower surface of the grinding stones after the grinding wheel is fitted to the mount.

2. The grinding apparatus according to claim 1, wherein the detecting unit further comprises:

a cylinder;

a table, wherein a lower portion of the table is housed in the cylinder and an upper portion of the table projects upward from the cylinder; and a sensor.

3. The grinding apparatus according to claim 2, wherein the sensor is a transmissive type photoelectric sensor.

4. The grinding apparatus according to claim 2, wherein the sensor includes a light emitting portion and a light receiving portion.

5. The grinding apparatus according to claim 2, wherein the sensor is an acoustic emission sensor having a contact at an upper end of the table.

6. The grinding apparatus according to claim 2, wherein the detecting unit is connected to an air source and the table is biased upwardly by pressurized air within the cylinder supplied by the air source.

7. The grinding apparatus according to claim 2, wherein the detecting unit includes a spring connected to a lower surface of the table and an internal bottom portion of the cylinder to bias the table upwardly.

* * * * *